United States Patent [19]

Stefansson et al.

[11] 4,362,298

[45] Dec. 7, 1982

[54] ANGULAR-LINEAR SHEET TRANSPORTS

[75] Inventors: Rafn Stefansson, San Marino; Raymond M. McManaman, Glendora, both of Calif.

[73] Assignee: Bell & Howell Company, Chicago, Ill.

[21] Appl. No.: 228,487

[22] Filed: Jan. 26, 1981

[51] Int. Cl.[3] ..... B65H 9/04; B65H 9/16

[52] U.S. Cl. ..... 271/236; 271/245; 271/251

[58] Field of Search ..... 271/251, 236, 244, 245

[56] References Cited

U.S. PATENT DOCUMENTS

| | | | |
|---|---|---|---|
| 1,626,352 | 4/1927 | Olson | 271/251 |
| 2,464,173 | 3/1949 | Broadmeyer | 271/251 |
| 2,767,982 | 10/1956 | Noon | 271/251 |
| 4,045,018 | 8/1977 | Michelson | 271/251 |

FOREIGN PATENT DOCUMENTS

| | | | |
|---|---|---|---|
| 55-84744 | 6/1980 | Japan | 271/251 |

OTHER PUBLICATIONS

IBM Technical Disclosure Bulletin, vol. 16, No. 11, Apr. 1974, pp. 3676 and 3677, J. Guttehing.

*Primary Examiner*—Richard A. Schacher

*Attorney, Agent, or Firm*—Benoit Law Corporation

[57] ABSTRACT

Methods and apparatus for transporting a sheet first toward and then along a registration edge provide a support for the sheet having a sheet support surface adjacent the registration edge and a first drive wheel rotatable about a first axis for driving the sheet on the support surface. A second drive wheel rotatable about a second axis extending at right angles to the support surface is provided at the first drive wheel. Such first wheel is initially positioned at an angle to the registration edge and is rotated with the second wheel through a third wheel about the first axis, with the sheet being brought into peripheral engagement with the first drive wheel to transport the sheet on its support surface to the registration edge. The third wheel with the first wheel is then swiveled about the second axis and about the second wheel, toward parallel relationship with the registration edge. The swiveled first wheel is then further rotated with the second wheel through the third wheel about the first axis to transport the sheet along the registration edge. In practice, the third wheel with the first wheel may be laterally moved relative to the second wheel equidistantly about the second axis to swing the first wheel toward parallel relationship with the registration edge.

13 Claims, 5 Drawing Figures

ANGULAR-LINEAR SHEET TRANSPORTS

BACKGROUND OF THE INVENTION

Field of the Invention

The subject invention relates to methods and apparatus for aligning, by one edge, sheets of material, such as paper and the like, or checks, billing stubs and other documents. The subject invention also relates to document or sheet transports and processing systems.

Disclosure Statement

The following disclosure statement is made pursuant to the duty of disclosure imposed by law and formulated in 37 CFR 1.56(a). No representation is hereby made that information thus disclosed in fact constitutes prior art, inasmuch as 37 CFR 1.56(a) relies on a materiality concept which depends on uncertain and inevitably subjective elements of substantial likelihood and reasonableness, and inasmuch as a growing attitude appears to require citation of material which might lead to a discovery of pertinent material though not necessarily being of itself pertinent. Also, the following comments contain conclusions and observations which have only been drawn or become apparent after conception of the subject invention or which contrast the subject invention or its merits against the background of developments which may be subsequent in time or priority.

Various forms of sheet or paper feeding mechanisms and systems have become known over the years. For instance, U.S. Pat. No. 1,987,339, by R. Hitchcock, proposed a paper feeding mechanism having a plurality of driven rollers with circumferential grooves formed therein to coact with revoluble elements with angularly movable axes for transporting sheets relative to a guide. If operable as claimed, that proposal would appear to be rather limited in its application and practicality.

A proposal according to U.S. Pat. No. 2,767,982, by A. W. Noon, employs a drive wheel that rotates a round insert mounted in a hole in a bedplate on to which a sheet is inserted in an aligning mechanism. The sheet drive wheel is initially positioned at an angle to a sheet registration edge, in order to transport an inserted sheet to such registration edge. The drive wheel then propels itself on the transported sheet to a parallel relationship with the registration edge, whereby the sheet is driven further along that registration edge. According to that proposal, the sheet drive wheel is mounted on a yoke via a swinging arm, and is driven via a flexible shaft extending parallel to the bedplate or sheet support. This limits the practicality of that proposal and its versatility of practical application.

The same appears to be the case with respect to a proposal according to U.S. Pat. No. 2,819,078, by R. A. Durand, according to which a plurality of panel feeding rollers are castered about pivot pins held in a yoke structure, and are driven by individually allocated motors via chain drives.

A proposal according to U.S. Pat. No. 2,888,261, by M. M. Barnes, employs a plurality of slanted wheels with traction rims in a paper registering device. That proposal again appears to be of limited utility, inasmuch as the alleged aligning wheels are not driven and are set manually in what appears to be a compromise position.

A sheet side registration apparatus according to U.S. Pat. No. 3,107,089, by K. L. Lockey, mounts passive pressure rollers on spring-biased pivoted yokes independently of separate paper drive rollers, thereby tending to increase the bulk of the apparatus while apparently limiting its versatility. Similar systems with similar limitations appear from U.S. Pat. No. 3,614,091, by F. Bernardis, employing undriven castered aligning rollers in conjunction with drive rollers, and from U.S. Pat. No. 4,072,305, by K. Scheid et al, in which laterally weighted and pivoted rollers are positioned for cooperation with a conveyor belt.

For proposals of changing the orientation of sheets in sheet feeding and delivery systems without the aid of castering drive wheels, reference may be had to U.S. Pat. No. 3,880,420, by M. D. Martin, disclosing a bullet-shaped backstop, U.S. Pat. No. 3,881,721, by T. R. Hitch, disclosing contoured arresting devices, U.S. Pat. No. 3,907,276, by D. P. Gerbasi, disclosing a wobble jogger arrangement, U.S. Patent Publication B 3,917,258, by R. J. Miller, disclosing revolving barrel rollers, U.S. Pat. No. 3,980,296, by J. A. Craft et al, disclosing flexibly coupled whiffle rollers, and U.S. Pat. No. 4,014,539, by E. L. Goodwin, disclosing an angular path sheet conveying system employing a particular conveyor configuration and canted rollers for urging sheets into contact with an alignment guide.

Because of the failure of all these proposals to satisfy the need for an alignment and transport system in which a sheet could be loaded against a registration edge and then transported therealong by the same pivoted wheel in a simple and efficient apparatus, the prior art has time and again resorted to compromise solutions employing one or more individually driven first sheet drive wheels for loading the sheet against a registration edge, and photocell-controlled, individually driven second sheet drive wheels for thereafter transporting the sheet along the registration edge. Such an approach has militated against attempts at reducing bulk, complexity, and costs of the system.

SUMMARY OF THE INVENTION

It is a general object of this invention to overcome the disadvantages and meet the needs expressed or implicit in the above disclosure statement or in other parts hereof.

It is a germane object of this invention to provide improved sheet aligning methods and apparatus.

It is a related object of this invention to provide improved sheet transporting methods and apparatus.

It is also an object of this invention to provide improved sheet registration systems.

Other objects of the invention will become apparent in the further course of this disclosure.

The subject invention resides in methods and apparatus for transporting a sheet first toward and then along a registration edge. According to a first aspect thereof, the invention provides a first drive wheel rotatable about an angularly movable first axis, and a second drive wheel rotatable about a second axis intersecting the first axis at an angle. The first wheel is provided laterally with a circular driven part extending about the first axis in a tangential plane of the second wheel. The first wheel is positioned at an angle to the registration edge and is rotated with the second wheel through the driven part about the first axis. The sheet to be transported is brought into peripheral engagement with the first drive wheel, in order to transport such sheet to the registration edge.

The subject aspect of the invention then laterally moves the circular driven part with the first wheel relative to the second wheel equidistantly about the second axis to swing the first wheel toward parallel relationship with the registration edge. The swung first wheel is further rotated with the second wheel through the driven part about the first axis to transport the sheet along the registration edge.

In practice, a support for the sheet having a sheet support surface adjacent the registration edge may be provided. The first drive wheel is rotatable about a first axis for driving the sheet on the support surface. A second drive wheel is provided at the first drive wheel and is rotatable about a second axis extending at right angles to the support surface. A third wheel is also provided for driving the first wheel. Such first wheel is again positioned at an angle to the registration edge and is rotated with the second wheel through the third wheel about the first axis. A sheet is brought into peripheral engagement with the first drive wheel to transport the sheet on the support surface to the registration edge. The third wheel is then swiveled with the first wheel about the second axis and about the second wheel, toward parallel relationship with the registration edge. Such swiveled first wheel is then further rotated with the second wheel through the third wheel about the first axis to transport the sheet along the registration edge.

BRIEF DESCRIPTION OF THE DRAWINGS

The subject invention and its various objects and aspects will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figures 1, 2:
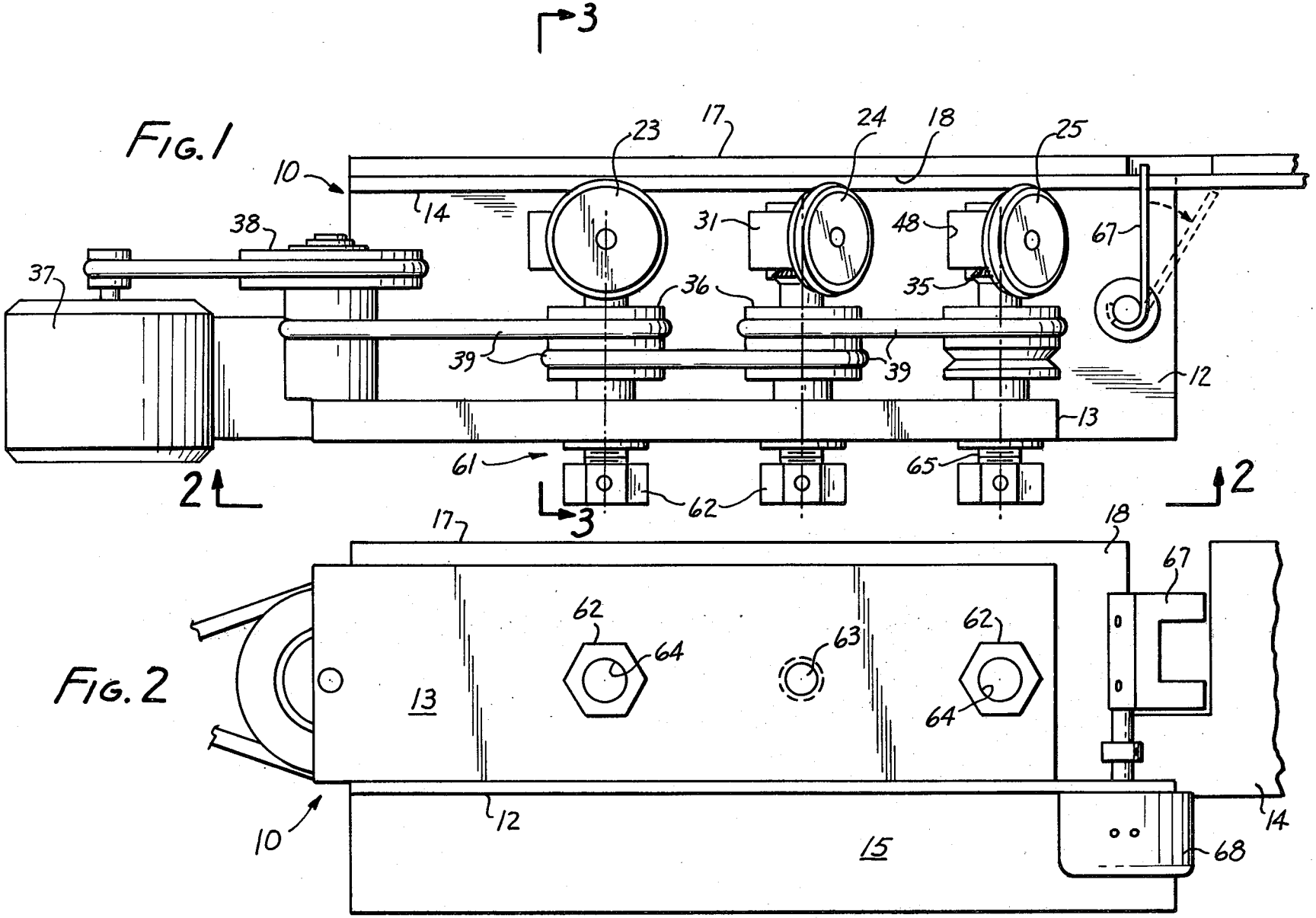
FIG. 1 is a top view of a sheet transporting apparatus according to a preferred embodiment of the subject invention.
FIG. 2 is a side view taken along the line 2—2 in FIG. 1.

The sheet or paper alignment and transport apparatus 10 shown in FIGS. 1 to 5 has a baseplate 12 and a mounting plate 13 extending perpendicularly thereto along one edge thereof. A registration edge or bar 14 extends along the other edge of the baseplate 12. As indicated in FIG. 2, the baseplate 12 may be attached to or part of a frame 15.

The objective of the apparatus shown in the drawings is to transport a sheet first toward and then along the registration edge 14 with the same paper drive wheel or wheels. A cross section of a sheet to be transported has been indicated in FIG. 3 in dotted lines at 16.

Figure 3:
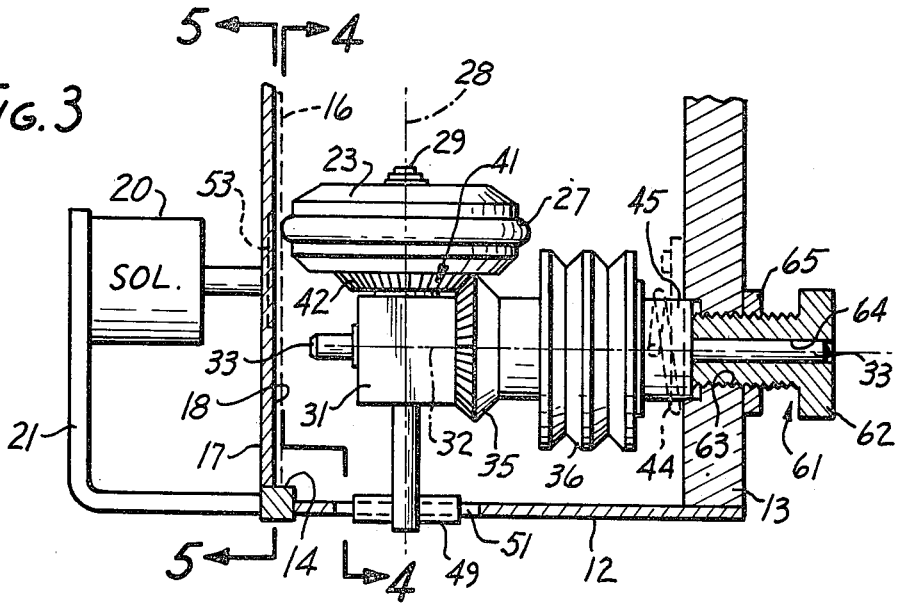
FIG. 3 is a section taken along the line 3—3 in FIG. 1.

The apparatus 10 has a support 17 having a sheet support surface 18 adjacent the registration edge 14. The support plate 17 may be fixed relative to the baseplate 12, registration edge 14 and frame 15. Alternatively, and as shown in FIG. 3, the sheet support plate 17 may be moveable, such as by means of a solenoid or other actuator 20 mounted on a bracket 21 attached to the registration edge or bar 14 and frame 15. By way of example, the solenoid 20, upon actuation thereof, may operate to bring the sheet support plate 17 into close proximity to sheet drive wheels and, upon deactuation thereof, may withdraw the sheet support plate 17 from such sheet drive wheels.

In principle, a single sheet drive wheel 23 could be employed for sheet alignment and transportation purposes. However, three sheet drive wheels 23, 24, and 25 are employed in the apparatus 10 as shown in FIG. 1 for moving each sheet first toward and then along the registration edge 14. If desired, the three sheet drive wheels 23 to 25 may be identical in design and construction.

Figure 4:
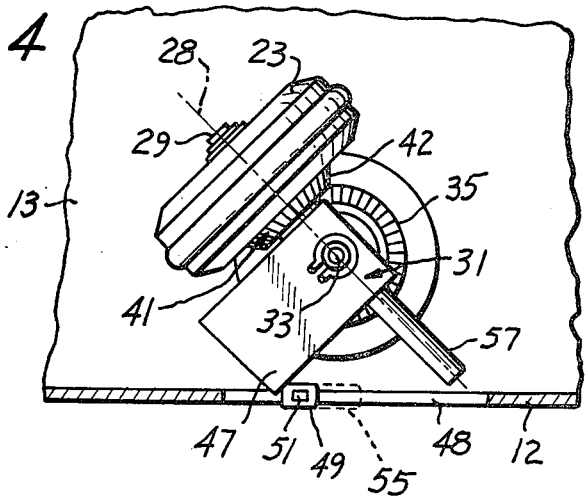
FIG. 4 is a view, partially in section, taken along the stepped line 4—4 in FIG. 3.

Accordingly, FIGS. 3 and 4 and their accompanying text herein may be referred to for a detailed description of the sheet drive wheels 23 to 25 and their support and drive.

In particular, the sheet drive wheel 23 shown in FIGS. 1, 3 and 4, has a circumferential friction surface or tire 27 for peripherally engaging the sheet 16 for transportation thereof on the support surface 18.

The first drive wheel 23 is rotatable about an angularly movable first axis 28. To this end, the wheel 23 is rotatably mounted on a shaft 29 which, in turn, is mounted in a block 31. The mounting block 31, in turn, is mounted for angular movement about a second axis 32 on a shaft 33. As seen in FIG. 3 the sheet drive wheel 23 extends at right angles to the sheet support surface and its axis of rotation 28 is parallel to that sheet support surface 18.

The second axis 32 extends at an angle to the first axis 28. Preferably, the second axis intersects the first axis at right angles, but other angular arrangements are conceivable within the scope of the subject invention.

In practice, the second shaft 33 may extend through the mounting assembly as seen in FIG. 3. If the axes 28 and 33 are intersecting, the first shaft 29 may then only extend partially into the mounting block 31, with the wheel 23 being made rotatable about the shaft 29.

A second drive wheel 35 is rotatable about the second axis 32 intersecting the first axis 28 at an angle. The second drive wheel 35 may be connected to or integral with a pulley 36. Both the second wheel 35 and pulley 36 may be rotatably mounted on the second shaft 33. As seen in FIG. 1, the pulleys 36 are driven by an electric motor 37 via a transmission 38 and belting 39.

The illustrated preferred embodiment also provides for the first wheel 23 a third wheel 41 for driving the first wheel.

The third wheel 41 may be in driving engagement with the first wheel 23 and also with the second wheel 35. To this end, the third wheel 41, as seen in FIGS. 3 and 4, may be realized by providing the first wheel 23 laterally with a circular driven part 42 extending about the first axis 28 in a tangential plane of the second wheel 35. The latter tangential plane may be flat and extend perpendicularly to the first axis 28, if the second wheel 35 were an externally-toothed pinion, and the third wheel 41, within the scope of the invention, were a crown wheel engaging such second wheel at an outer periphery thereof. On the other hand, in the case of meshing bevel gears at 35 and 41 as shown in FIGS. 3 and 4, the mentioned tangential plane may extend at an angle to the axis 28 and may even be curved, as in the form of a cone about the first axis 28 or a cone about the second axis 32.

For the purpose of better visibility of various parts, FIGS. 1 and 3 show the first drive wheel in an erected position. However, it should be understood that the first drive wheel or wheels are initially positioned at an angle to the registration edge 14. Reference may in this respect be had to FIG. 4 for an illustration of an appropriate initial angular position of the first drive wheel 23.

In principle, a bias spring, such as illustrated in dotted outline at 44 in FIG. 3, could be employed for biasing the first drive wheel 23 to its initial angular position shown in FIG. 4. This, of course, presupposes that a bushing 45 is connected to the mounting block 31 so that the angular bias of the spring 44 is transmitted to the mounting block 31, thereby translating into an angular bias of the shaft 29 with first axis of rotation 28. In operation, the first drive wheel 23 would then erect itself toward the position shown in FIG. 3 against the bias of the spring 44. In practice, this typically would require the drive wheel 23 to overcome a progressively increasing spring bias force as it climbs along the sheet 16 to its erected position. This may be avoided as follows.

According to a preferred embodiment of the subject invention, a mass or weight 47 is employed for urging the first wheel 23 to its initial slanted position. As seen in FIG. 4, the weight 47 may form part of or constitute the mounting block 31. The baseplate 12 is advantageously provided with an aperture 48 having a stop 49 located therein.

The stop 49 may be formed by an elongate tooth 51 projecting into the aperture 48 and having, for instance, an elastomeric sleeve located thereon.

As seen in FIG. 4, the weight 47 enters with one of its corners with aperture 48, and abuts against the stop 49, thereby removably retaining the first drive wheel 23 in its initial inclined position.

In such initial or angular position, the first wheel 23 is rotated with the second wheel 35 through the third wheel 41 or lateral driven part 42. In practice, it is preferable that the motor 37 drive the wheels continuously while the apparatus is in operation and is waiting for an insertion of sheets or cards. This, however, presupposes that the rim 27 of the drive wheel not contact the sheet support surface 18 at the time, since such a contact could cause the drive wheel 23 to climb up on the surface 18 to its erected position before a sheet were inserted.

In this respect, selective actuation and deactivation of the solenoid 20 may be employed for assuring the requisite spacing between surface 18 and drive wheel 23. However, it should be recognized that it would be preferable to employ the solenoid for achieving a desired initial spacing between plate 17 and wheel 23, with other means being employed for preventing a climbing of the wheel 23 on the surface 18 itself.

In this respect, a round insert mounted in a hole in the support plate 17 as shown, for instance, at 108 in FIGS. 6 and 7 of the above mentioned U.S. Pat. No. 2,767,982, issued Oct. 23, 1956, to A. W. Noon, and herewith incorporated by reference herein, may be employed.

In practice, the solenoid 20 would actuate the plate 18 so that the wheel rim 27 would contact and rotate such a round insert. While this would be within the broad scope of the subject invention, another solution presently disclosed with the aid of FIGS. 3 and 5 is preferred, since the mentioned round insert may in practice tend to create sufficient friction for an undesirable climbing or failure of return of the wheel 23.

Figure 5:
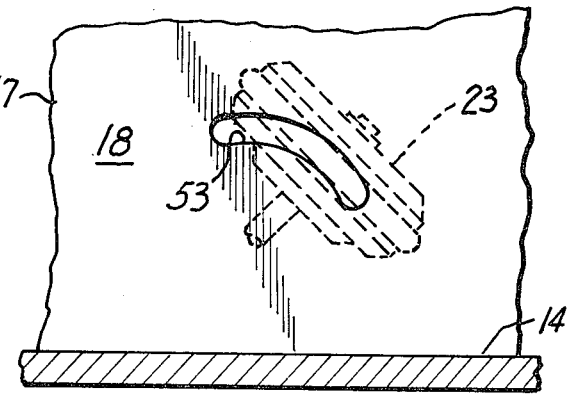
FIG. 5 is a view taken along the line 5—5 in FIG. 3.

The latter drawback is avoided by the preferred embodiment of the invention illustrated in FIGS. 3 and 5.

In particular, FIG. 5 shows the provision of an arcuate groove 53 in the plate 17 at the sheet supporting surface 18. A side view of groove 53 is indicated in dotted outline in FIG. 3. In this respect, FIG. 5 shows a projection of the first drive wheel 23 onto the sheet support surface 18, in order to illustrate a preferred relationship of the groove 53 relative to that drive wheel. In principle, the groove 53 need only cover the initial position of the sheet drive wheel and may thus be formed by a cavity in the support plate 17 and surface 18 at the position of the wheel 23 in its inclined location shown in FIGS. 4 and 5. On the other hand, as shown in FIG. 5, the cavity or groove 53 may be curved, such as in the manner of the curved trajectory of the angularly moving or climbing wheel 23, so that the drive wheel will return automatically from an advanced to its inclined initial position, without actuation of the solenoid 20 or similar measure being necessary at this juncture.

In practice, the plate 17 and, if employed, the solenoid 20, may act or form part of means for bringing the sheet into peripheral engagement with the rotating drive wheel 23 on the support 17, thereby bridging the groove 53 with the sheet 16.

The sheet 16 is thus brought into peripheral engagement with the first drive wheel 23 or, if desired, with two or more of the first drive wheels 23 to 25. This, in turn, causes the inclined drive wheel or wheels to transport the sheet 16 on the support surface 18 to the registration edge 14.

The third wheel 41 with the first wheel 23 is thereupon swiveled about the second axis 32, and about the second wheel 35, toward parallel relationship with the registration edge, as seen in FIG. 3. In this respect, and with reference to illustrated preferred embodiment of the invention, the angular movement of the wheel axis 28 from its initial inclined position is due to an imbalance of forces acting on the wheel 23 from the drive gear 35/42 and a reaction force exerted on the wheel 23 via its peripheral rim 27 by the sheet 16 abutting the reference edge 14. The relative location and direction of forces thus involved is a function of the geometry of the system, with the geometry illustrated in the drawings conforming to what is currently considered the best embodiment of the invention.

In this respect, it would also be possible within the scope of the invention to position the gear wheel 35 on the portion of the second shaft 33 seen in FIG. 3 as projecting from the mounting block 31. In that case, such alternatively positioned second wheel would be driven from the pulley 36 by a bushing extending through the block 31, or the shaft 33 would itself be constituted as a drive shaft. In practice, such an arrangement, while within the broad scope of the subject invention, has so far not worked as well as the arrangement shown in FIGS. 3 and 4, since friction at the gear 35 tends to set up a force which causes the wheel 23 to climb prematurely if such gear wheel is located on the projecting portion of the shaft 33.

FIG. 3 shows how the sheet drive wheel may swivel or swing into parallel relationship to the registration edge 14, to transport the positioned sheet 16 along the registration edge 14. While the achievement of such parallel relationship is within the broad scope of the subject invention, it is not absolutely necessary, and in some instances not even necessarily desirable, that the drive wheel 23 be swung into exact parallel relationship to the registration edge 14. Rather, as indicated in dotted outline at 55 in FIG. 4, the stop 55 may be extended or positioned so that it will prevent the sheet drive wheel 23 from reaching a complete upright position. In other words, the rotating wheel is swung toward parallel relationship with the registration edge 14, whether such wheel does or does not reach an exactly upright position or parallel relationship with the edge 14.

In the embodiment shown in the drawings, the circular driven part 42 or third wheel 41 may be laterally moved with the first wheel 23 relative to the second wheel 35 equidistantly about the second axis 32 to swing the first wheel toward parallel relationship with the registration edge 14. The mounting block 31 may be equipped with a projection or shaft 57 extending along part of the first axis of rotation 28 of the sheet drive wheel 23. If desired, such projection 57 may be laterally offset, in order to engage the stop 49 at the appropriate instant in the swiveling motion of the wheel 23. In either case, the swiveling motion of the wheel 23 is stopped as the projection 57 abuts against the stop 49.

The swiveled or swung first wheel 23 is further rotated with the second wheel 35 through the third wheel 41 or driven part 42 about the first axis 28 to transport the sheet 16 along the registration edge 14. If the wheel 23, by appropriate positioning of the stop elements 49 and 57 or otherwise, is prevented from reaching a fully upright position in parallel relationship to the edge 14, then the swiveled wheel will continue to exert a force component on the sheet 16 not only in a direction parallel to the edge 14, but also at an angle to such edge. In this manner, the registering sheet 16 will experience a continued loading against the registration edge 14 for a precise positioning relative to printing and electrooptical reading or other equipment.

In addition or alternatively to the solenoid 20, a mechanism 61 may be employed for precisely adjusting the distance between the sheet drive wheel 23 or rim 27 and the sheet support surface 18. The mechanism 61 includes a threaded bolt 62 which meshes with the mounting plate 13 at an internally threaded hole 63 thereof. The threaded bolt 62 has a longitudinal bore 64 for receiving the shaft 33 in sliding engagement therewith. A threaded nut 65 permits arrestation of the threaded bolt 62 in any set position. The bolt 62 works against bushing 45 in setting the wheel 23 and its supporting assembly in any desired position relative to the sheet support surface 18.

The illustrated embodiment of the invention permits an aligned sheet to be temporarily retained at the drive wheels 23 to 25 against transportation by these rotating drive wheels. For instance, FIGS. 1 and 2 show an electromechanical gate 67 at the sheet support 17 or surface 18, in a closed and in an open position, respectively. In its closed position shown in FIG. 1, the gate 67 retains an aligned sheet 16 in registration with the edge 14 until a subsequent apparatus is ready to receive the sheet. Damage to the sheet by the rotating drive wheels 23 to 25 is precluded by an appropriate setting of the friction between the rims 27 and the inserted sheet 16, such as by an adjustment of the threaded bolt 61 to provide an appropriate spacing between each rim 27 and sheet support surface 18.

As soon as the apparatus to which the aligned sheet is to be fed is ready, an actuator 68 may be energized to open the gate 67 as shown in FIG. 2. This enables the drive wheels 23 to 25 to advance the aligned sheet 16 further along the registration edge 14 and into any conveyor belt system or other apparatus, after the retained sheet 16 has been released by an opening of the gate 67.

Upon departure of the aligned sheet from the apparatus 10, the drive wheels 23 to 25 return automatically to their inclined initial position, ready to receive and align the next sheet.

The subject invention and its preferred embodiments overcome the initially stated problems and meet the above-mentioned needs and objectives, and provide improved sheet aligning and transportation methods and apparatus, including sophisticated equipment for, by way of example, positioning checks, billing stubs and other documents in modern document and information processing systems in a reliable, precise and repetitive manner.

The subject extensive disclosure will render apparent or suggest to those skilled in the art various modifications and variations within the spirit and scope of the disclosed invention or equivalents thereof.

We claim:

1. A method of transporting a sheet first toward and then along a registration edge, comprising in combination the steps of:

providing a support of said sheet having a sheet support surface adjacent said registration edge;

providing a first drive wheel at right angles to said sheet support surface and rotatable about an angularly movable first axis extending parallel to said sheet support surface;

providing a second drive wheel rotatable about a second axis intersecting said first axis at an angle;

providing said first wheel laterally with a circular driven part extending about said first axis in a tangential plane of said second wheel;

positioning said first wheel at an angle to said registration edge and rotating said first wheel with said second wheel through said driven part about said first axis and bringing said sheet into peripheral engagement with said first drive wheel to transport said sheet on said sheet support surface to said registration edge;

laterally moving said circular driven part with said first wheel relative to said second wheel equidistantly about said second axis to swing said first wheel toward parallel relationship with said registration edge;

further rotating said swung first wheel with said second wheel through said driven part about said first axis to transport said sheet along said registration edge;

temporarily retaining said sheet at said first drive wheel against transportation by said rotating first drive wheel and in alignment with said registration edge; and subsequently releasing said retained sheet for further advancement along the registration edge by said rotating first drive wheel.

2. A method of transporting a sheet first toward and then along a registration edge, comprising in combination the steps of:

providing a support for said sheet having a sheet support surface adjacent said registration edge;

providing a first drive wheel at right angles to said sheet support surface rotatable about a first axis extending parallel to said sheet support surface for driving said sheet on said support surface;

providing at said first drive wheel a second drive wheel rotatable about a second axis extending at right angles to said support surface;

providing for said first wheel a third wheel for driving said first wheel;

positioning said first wheel at an angle to said registration edge and rotating said first wheel with said second wheel through said third wheel about said first axis and bringing said sheet into peripheral engagement with said first drive wheel to transport said sheet on said support surface to said registration edge;

swiveling said third wheel with said first wheel about said second axis and about said second wheel, toward parallel relationship with said registration edge;

further rotating said swiveled first wheel with said second wheel through said third wheel about said first axis to transport said sheet along said registration edge;

temporarily retaining said sheet at said first drive wheel against transportation by said rotating first drive wheel and in alignment with said registration edge; and subsequently releasing said retained sheet for further advancement along the registration edge by said rotating first drive wheel.

3. A method of transporting a sheet first toward and then along a registration edge, comprising in combination the steps of:

providing a support for said sheet having a sheet support surface adjacent said registration edge;

providing a groove in said support at said sheet support surface and at an angle to said registration edge;

positioning a sheet drive wheel adjacent said support at an angle to said registration edge and at right angles to said sheet support surface, with said groove providing a spaced relationship between said support and said wheel;

adjusting a distance between said sheet drive wheel and said sheet support surface at said groove;

rotating said wheel in said spaced relationship to said support about an axis of rotation extending parallel to said sheet support surface;

bridging said groove with said sheet and bringing said sheet into peripheral engagement with said rotating drive wheel to transport said sheet on said sheet support surface to said registration edge;

swinging said rotating wheel toward parallel relationship with said registration edge to transport said sheet along said registration edge;

temporarily retaining said sheet at said sheet drive wheel against transportation by said rotating sheet drive wheel and in alignment with said registration edge; and subsequently releasing said retained sheet for further advancement along the registration edge by said rotating sheet drive wheel.

4. A method as claimed in claim 1 or 2, including the step of:

adjusting a distance between said first or sheet drive wheel and said sheet support surface.

5. A method as claimed in claim 1, 2 or 3, including the steps of:

providing a weight; and urging with said weight said first or sheet drive wheel to an initial slanted position relative to said registration edge.

6. A method as claimed in claim 1, 2 or 3, including the step of:

continuously loading said sheet against said registration edge by preventing said first or sheet drive wheel from reaching said parallel relationship with said registration edge.

7. In apparatus for transporting a sheet first toward and then along a registration edge, the improvement comprising in combination:

a support for said sheet having a sheet support surface adjacent said registration edge;

a first drive wheel rotatable about an angularly movable first axis;

means for mounting said first drive wheel at right angles to said sheet support surface, with said first axis extending parallel to said sheet support surface;

a second drive wheel rotatable about a second axis intersecting said first axis at an angle;

a circular driven part laterally on said first wheel and extending about said first axis in a tangential plane of said second wheel;

means coupled to said second wheel for rotating said first wheel with said second wheel through said driven part about said first axis;

means for initially positioning said first wheel at an angle to said registration edge for transportation of said sheet to said registration edge on said support surfaces upon engagement of said sheet with said first drive wheel, and for lateral movement of said circular driven part with said first wheel relative to said second wheel equidistantly about said second axis for swinging motion of said first wheel toward parallel relationship with said registration edge for transportation of said sheet along said registration edge upon further rotation of said swung first wheel with said second wheel through said driven part about said first axis; and means including a gate at said sheet support surface, having a closed position for temporarily retaining said sheet at said first drive wheel against transportation by said rotating first drive wheel and in alignment with said registration edge and having an open position for selectively releasing said retained sheet for further advancement along the registration edge by said rotating first wheel.

8. In apparatus for transporting a sheet first toward and then along a registration edge, the improvement comprising in combination;

a support for said sheet having a sheet support surface adjacent said registration edge;

a first drive wheel rotatable about a first axis for driving said sheet on said support surface;

means for mounting said first drive wheel at right angles to said sheet support surface, with said first axis extending parallel to said sheet support surface;

a second drive wheel at said first drive wheel rotatable about a second axis extending at right angles to said support surface;

a third wheel in driving engagement with said first wheel;

means coupled to said second wheel for rotating said first wheel with said second wheel through said third wheel about said first axis;

means for initially positioning said first wheel at an angle to said registration edge for transportation of said sheet to said registration edge on said support surface upon engagement of said sheet with said first drive wheel, and for swiveling movement of said third wheel with said first wheel about said second axis and about said second wheel, toward parallel relationship with said registration edge for transportation of said sheet along said registration edge upon further rotation of said swiveled first wheel with said second wheel through said third wheel about said first axis; and means including a gate at said sheet support surface, having a closed position for temporarily retaining said sheet at said first drive wheel against transportation by said rotating first drive wheel and in alignment with said registration edge and having an open position for selectively releasing said retained sheet for further advancement along the registration edge by said rotating first wheel.

9. In apparatus for transporting a sheet first toward and then along a registration edge, the improvement comprising in combination:

a support for said sheet having a sheet support surface adjacent said registration edge;

a groove in said support at said sheet support surface and at an angle to said registration edge;

a sheet drive wheel;

means for positioning said sheet drive wheel adjacent said support at an angle to said registration edge and at right angles to said sheet support surface for rotation about an axis extending parallel to said sheet support surface, with said groove providing a spaced relationship between said support and said wheel;

a mechanism coupled to said sheet drive wheel for adjusting the distance between said sheet drive wheel and said sheet support surface at said groove;

means for rotating said wheel in said spaced relationship to said support;

means including said support for bringing said sheet into peripheral engagement with said rotating drive wheel on said support thereby bridging said groove with said sheet, to transport said sheet on said sheet support surface to said registration edge;

said positioning means including means permitting swinging of said rotating wheel toward parallel relationship with said registration edge to transport said sheet along said registration edge; and means including a gate at said sheet support surface, having a closed position for temporarily retaining said sheet at said sheet drive wheel against transportation by said rotating sheet drive wheel and in alignment with said registration edge and having an open position for selectively releasing said retained sheet for further advancement along the registration edge.

10. Apparatus as claimed in claim 7, 8 or 9, including: an actuator coupled to said support for moving said support relative to said first or sheet drive wheel.

11. Apparatus as claimed in claim 7 or 8, including: a mechanism coupled to said first drive wheel for adjusting the distance between said first drive wheel and said sheet support surface.

12. Apparatus as claimed in claim 7, 8 or 9, wherein: said positioning means include a weight coupled to said first or sheet drive wheel for urging said first or sheet drive wheel to an initial slanted position relative to said registration edge.

13. Apparatus as claimed in claim 7, 8 or 9, including: means for continuously loading said sheet against said registration edge by preventing said first or sheet drive wheel from reaching said parallel relationship with said registration edge.

* * * * *